United States Patent [19]

Niederer

[11] 3,943,731

[45] Mar. 16, 1976

[54] METHOD AND MEANS FOR FORMING KNIT FABRIC INCORPORATING A FANCY WARP STITCH WEAVE

[75] Inventor: Kurt W. Niederer, Charlotte, N.C.

[73] Assignee: W. Schlafhorst & Co., Monchen-Gladbach, Germany

[22] Filed: Dec. 30, 1974

[21] Appl. No.: 537,344

Related U.S. Application Data

[63] Continuation-in-part of Ser. No. 423,485, Dec. 10, 1973, Pat. No. 3,874,201, which is a continuation-in-part of Ser. No. 64,435, Aug. 17, 1970, abandoned.

[52] U.S. Cl. ..... 66/86 B

[51] Int. Cl.[2] ..... D04B 23/00; D04B 27/00

[58] Field of Search ..... 66/86, 84, 109, 87, 190, 66/191, 192, 193, 195

[56] References Cited

UNITED STATES PATENTS

| | | | |
|---|---|---|---|
| 1,661,055 | 2/1928 | Springthorpe | 66/84 |
| 1,711,624 | 5/1929 | Vorck et al. | 66/192 X |
| 1,841,165 | 1/1932 | Vorck et al. | 66/84 A UX |
| 1,924,649 | 8/1933 | Morton | 66/87 X |
| 2,504,316 | 4/1950 | Fontaine | 66/86 B |
| 2,562,034 | 7/1951 | Hannay | 66/86 B |
| 3,665,733 | 5/1972 | Jackson | 66/87 |
| 3,718,010 | 2/1973 | Kohl | 66/84 |
| 3,802,226 | 4/1974 | Kohl | 66/86 B |

*Primary Examiner*—Ronald Feldbaum
*Attorney, Agent, or Firm*—Richards, Shefte & Pinckney

[57] ABSTRACT

A knit fabric is made to simulate a woven structure by arranging fancy warp stitch chains at spacings between inlaid warp ends so that filling ends laid at one side of the warp ends are knit-in while filling ends laid at the other side remain simply laid-in and are held in place by interaction of the warp ends and warp stitch chains thereat.

3 Claims, 9 Drawing Figures

16
w
t"
b"
14'
b'
t'
y
s
b
l
l'
c
t
14
12
10

16
w
t"
b"
b'
y
14'
14
t'
s
b
l
l'
c
t
12
10

METHOD AND MEANS FOR FORMING KNIT FABRIC INCORPORATING A FANCY WARP STITCH WEAVE

CROSS-REFERENCES TO RELATED APPLICATIONS

This is a continuation-in-part of parent application Ser. No. 423,485, filed Dec. 10 1973 which contains claims to the knit fabric disclosed and now allowed as U.S. Pat. No. 3,874,201 which is a continuation-in-part of Ser. No. 64,435 filed Aug. 17, 1970, now abandoned.

BACKGROUND OF THE INVENTION

In commonly assigned copending application Ser. No. 64,435, filed Aug. 17, 1970, now abandoned, a warp knitting machine is disclosed and claimed that is arranged for inserting a filling end both in front of and behind the knitting needles to produce a warp knit fabric having "a woven-like characteristic." The warp knit fabric resulting from the machine arrangement of this copending application, however, has all of the filling ends knit-in by warp stitch chains so that the filling ends are held whether or not additional unknit warp ends are included in the fabric, and if such warp ends are included they are held by disposition of the filling ends at both sides thereof without any holding purpose being served by the warp with respect to the filling. As a consequence, even though fabric produced according to the above-noted copending application exhibits excellent stability, it does not interlace the fabric elements sufficiently to provide a woven appearance as fully as is desirable.

SUMMARY OF THE INVENTION

According to the present invention filling ends are laid at both sides of spaced ends of a warp inlay but are knit-in at only one side by warp stitch chains running at the spaces between the warp ends while the filling ends at the other side are simply laid-in at an interlaced relation with the warp ends and warp stitch chains, so that a pronounced woven appearance is obtained in the resulting fabric particularly when the warp stitch chains are formed of appreciably finer yarn than is used for the warp and filling inlay.

Formation of the fabric in this manner is accomplished by inlaying spaced warp ends at the back side of a needle array with filling ends laid at opposite sides thereof while operating the needle array to form knitting ends delivered thereto into warp stitch chains at the spaces between the warp ends, and while holding in back of the needle array all filling ends at the warp inlay side adjacent the needles of the array and forcing all filling ends at the other warp inlay side to the front of the needles in timed relation, so that the filling ends forced to the front of the needles are knit-in and those held in back are interlaced.

The fabric structure obtained and the manner in which, and means by which, it is formed are described in further detail below in connection with the accompanying drawings.

DETAILED DESCRIPTION OF THE INVENTION

Figure 1:
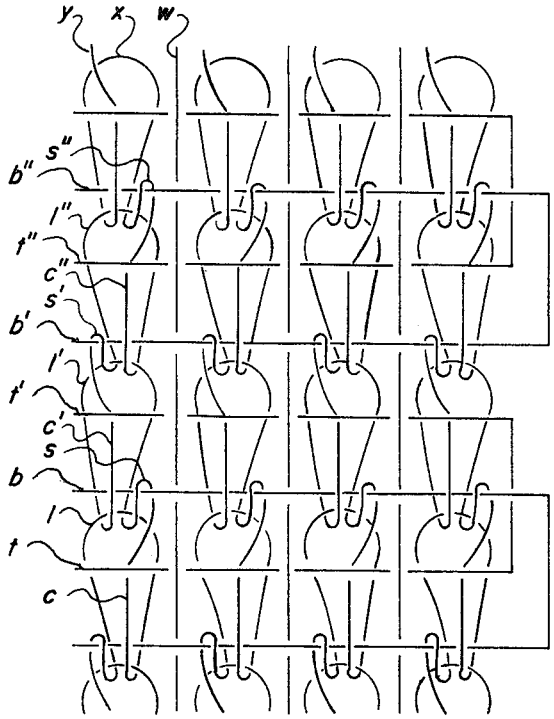
FIG. 1 is a diagram of knit fabric embodying the present invention.

Fabric embodying the present invention incorporates four yarn systems: a warp inlay of spaced ends *w;* a system of filling ends *t* laid at one warp inlay side, which may be considered the top side; an alternating opposite or bottom side system of filling ends *b;* and, a system of knitting ends *y* from which warp stitch chains *x* are formed between the spaced ends *w* of the warp inlay. FIG. 1 diagrams the form of the fabric when the filling ends *t* and *b* of the alternating systems are regularly spaced. Under such circumstances, the warp stitch chains *x* run or pass entirely outside of all top side filling ends, as at *t*, *t'* and *t''*, while engaging all bottom side filling ends, as at *b*, *b'* and *b''*, so that the latter filling ends are knit-in while the former remain simply laid-in.

More particularly, the constituent parts to the stitch chains *x* consist of successive loops, as at *l*, *l'* and *l''* in FIG. 1, and connecting segments extending between such successive loops, as at *c*, *c'* and *c''*. And when the filling ends are regularly spaced as in FIG. 1, both legs of the stitch chain loops pass outside of the top side filling ends and inside of the bottom side filling ends thereat, while the connecting segments, as at *c'*, run outside of a bottom side filling end, such as *b*, adjacent the throat of the loop *l'* from which it extends and outside the top side filling end *t'* at this loop and then form a sub-loop portion, as at *s*, *s'* or *s''*, to one side of the loop bight which wraps from inside out around the adjacent top side filling end, such as *t'*, before connecting with the next succeeding loop *l''*. As thus arranged, the stitch chains *x* interlace in sinuous fashion with both the top and bottom side filling so as to cause interaction thereof with the warp inlay to produce woven structure simulation, and in doing so leaves the top side filling fully visible at the bottom fabric face, except as such filling passes under the warp inlay thereat, and in this way further emphasizes woven structure simulation at this face.

Figure 2:
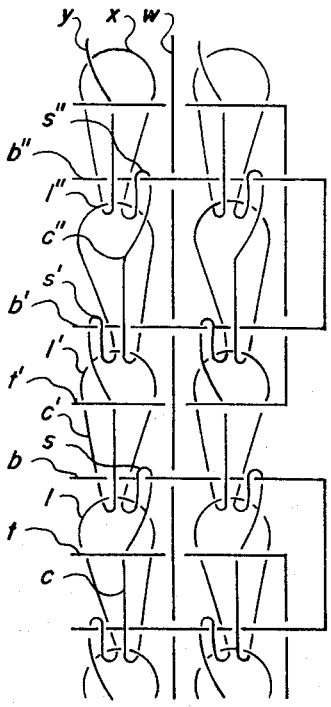
FIG. 2 is a comparable diagram illustrating a varied spacing of the filling ends for patterning.
Figure 3:
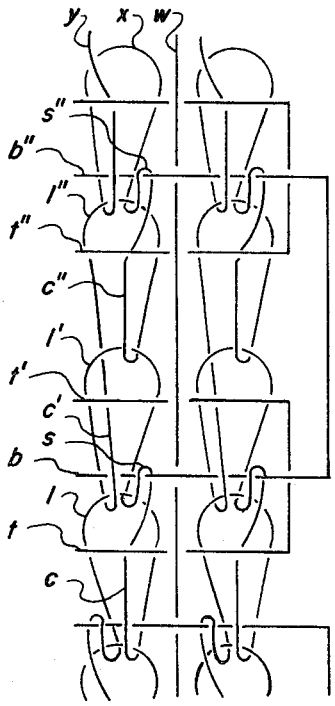
FIG. 3 is a third diagram of the same sort illustrating a further variation of the filling end spacing.

FIGS. 2 and 3 illustrate the effect of varying the filling end spacing at either fabric face for patterning purposes. In FIG. 2 the spacing has been varied so as in effect to omit the top side filling *t''* in relation to FIG. 1, while in FIG. 3 the counterpart of bottom side filling end *b'* is eliminated. Omission of a top side filling end as in FIG. 2 shows up patternwise predominantly at the bottom fabric face by interrupting the regularity thereat where top side filling visibility is not obscured by any stitch chain portion. On the other hand, bottom side filling omission, as in FIG. 3, has the effect of eliminating the sub-loop portions *s'* in the connecting segment *c'* that would have wrapped about the omitted filling, so as to render the stitch form conventional rather than fancy at this point and provide pattern variation in this way as well as from the filling omission. It will be recognized that either or both variations in filling spacing can be employed as desired; that the illustrated spacing variations are only representative and are each subject to further variation; and that further patterning possibilities are available through selective omission of stitch chains *x* or ends of the warp inlay *w*.

Formation of the FIG. 1 fabric in accordance with the present invention is illustrated sequentially in FIGS. 4 through 7. In these illustrations, the warp inlay *w* with top and bottom filling laid thereat is shown approaching at the back side of an array of latch needles 10 operable at a knock-over bar 12 in relation to corresponding arrays of sinkers 14 and yarn guides 16. The knitting ends *y* are delivered through the yarn guides 16 for formation of stitch chains at the warp inlay spacings, and the sinkers 14 perform three functions during stitch chain formation: first, they cause all top side filling (i.e., all filling at the warp inlay side adjacent or facing the needles) to remain at the back of needles 10; secondly, they force all bottom or opposite side filling to the front of needles 10; and thirdly, they act to hold down the fabric being knitted during rise of the needles.

Figure 4:
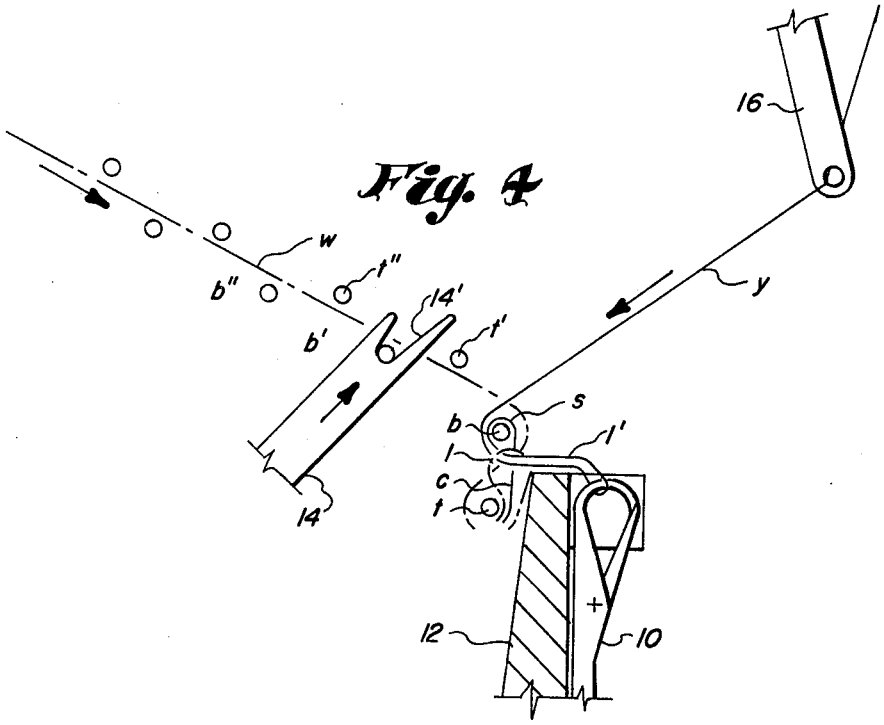
FIGS. 4 through 7 are sequential illustrations of the manner in which the FIG. 1 fabric is formed in accordance with the present invention.
Figure 5:
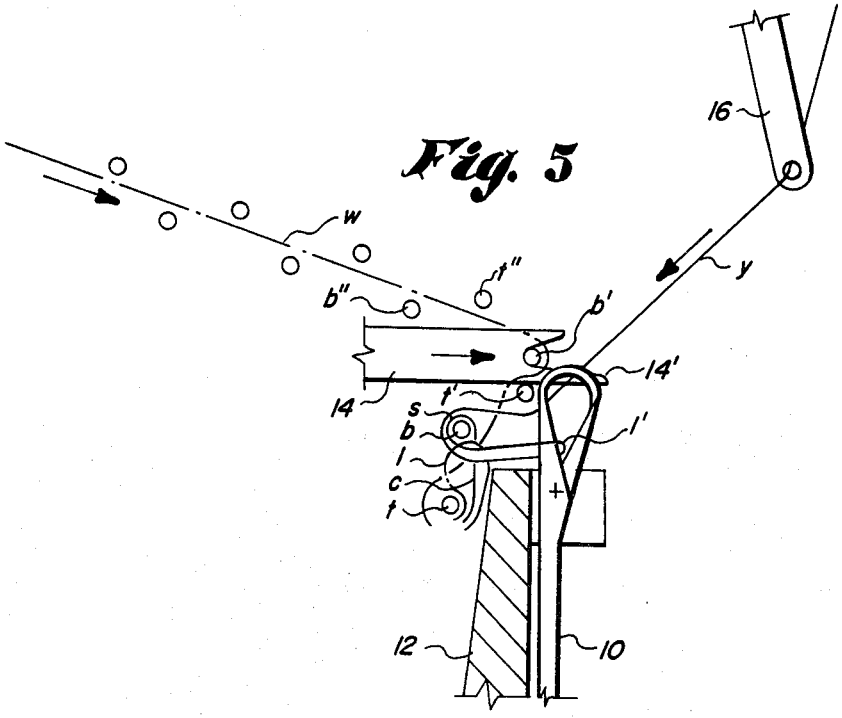

In FIG. 4 a stitch loop *l*, as previously diagrammed in FIG. 1, is shown as having been formed so as to pass outside of top filling end *t* (in relation to warp inlay *w*) together with connecting segment *c* which extends to form sub-loop *s* about the following bottom filling end *b* before connecting with the succeeding loop *l'* that is held by the lowered needle 10 to which the knitting end *y* extends after passing outside of the filling end *b*. Also, at this stage the sinker 14 has moved up to receive the next succeeding bottom filling end *b'* at the crotch of its forked end portion 14' while extending the bottom edge of this end portion above and beyond the immediately preceding top filling end *t'* so as to cause the latter to assume a position behind the needle 10 as it rises as the sinker 10 moves across its ascending path as seen in FIG. 5.

Figure 6:
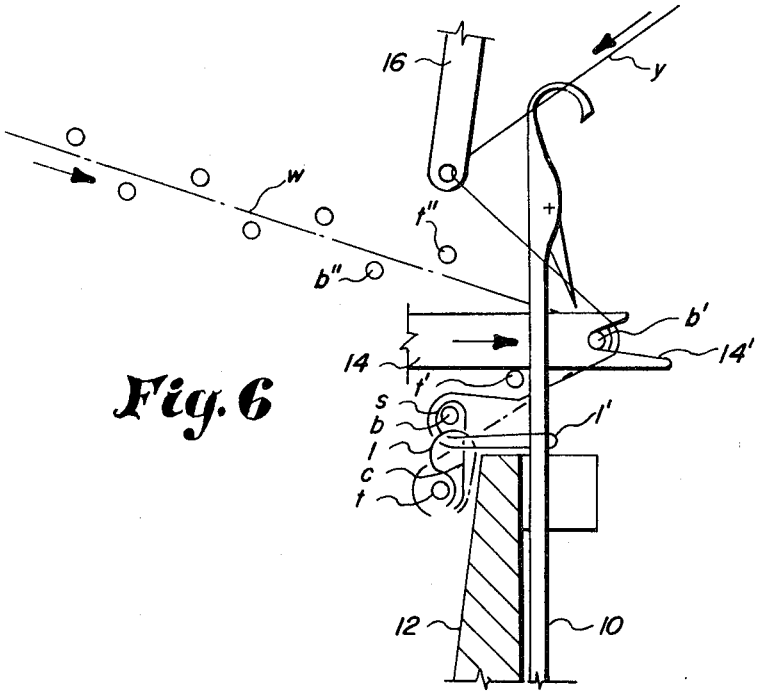
Figure 7:
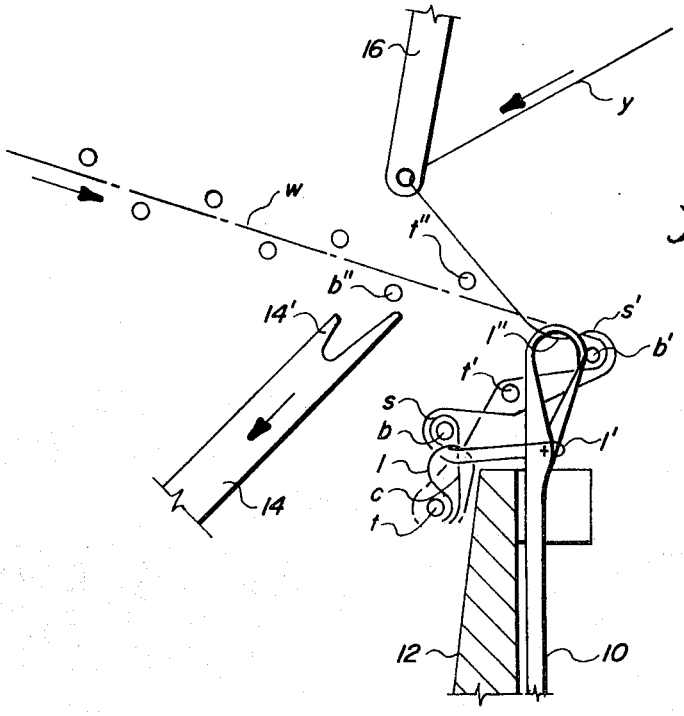

FIG. 6 shows the further progress of the sinker 14 after it has moved enough farther in timed relation with the rising needle 10 to have forced the bottom filling end *b'* to the needle front while the previously held loop *l'* has opened the needle latch and the yarn guide 16 has moved rearwardly to commence wrapping the knitting end *y* around needle 10 in preparation for forming the next succeeding loop *l''* as indicated in FIG. 7. At the FIG. 7 stage the sinker 14 has been retracted in preparation for a new cycle, the needle 10 has been lowered enough to close the latch and position the filling end *b'* for release to the back of the needle as it casts off the loop *l'* upon full lowering to the FIG. 4 position in completing a cycle.

Upon such full lowering, the sinker 14 will have moved up again, as in FIG. 4, but this time on the bottom filling end *b''*, while the needle 10 will now hold the fully formed loop *l''* instead of *l'* and the filling end *b'* will be wrapped by a fully formed sub-loop *s'*. Also, the yarn guide 16 will have returned to its forward position after an overlap shog to complete the wrapping of needle 10. In this latter connection, it should be noted that common practice dictates execution of the overlap shog alternately in opposite directions so as to avoid accumulating twist in the knitting ends *y*, and that this circumstance accounts for the fact that sub-loops *s*, *s''*, and so forth, appear on alternate sides of the stitch chain loops as diagrammed in FIG. 1.

Figure 8:
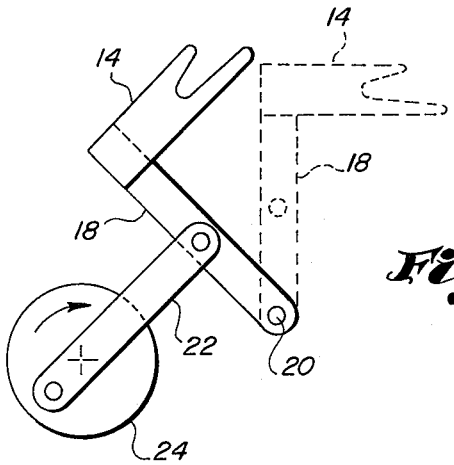
FIGS. 8 and 9 show suitable alternative means for operating the filling end sinker means.
Figure 9:
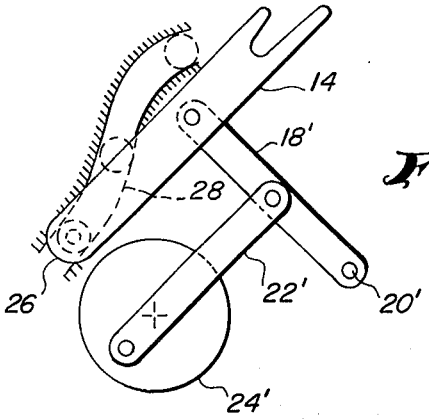

As the knit fabric is formed at the back of the knock-over bar 12 in the foregoing manner, it is handled by any suitable take-down arrangement (not shown) and the knitting ends *y* and warp inlay *w* are delivered from beam supplies with any usual sort of conveyor system being provided to receive and deliver the laid filling along with the warp inlay. Operation of the sinker 14 to perform the functions noted above in the manner described can be accomplished in a variety of conventional ways. Two suitable arrangements for such operation are illustrated in FIGS. 8 and 9. In FIG. 8 the sinker 14 is shown fitted with a right angular pivot leg 18 movable about a fixed pivot at 20 and having a connecting arm 22 extending intermediately therefrom to a crank plate 24 so as to time and execute the sinker motion as desired. The FIG. 9 arrangement is somewhat more elaborate in that the sinker 14 is extended in length to carry a follower pin 26 at its extending end to ride in a cam groove 28, while a pivot leg 18' is this time pivotally connected with sinker 14 and mounted at a fixed pivot 20' as well as deriving operating motion through a connecting arm 22' and crank plate 24'. Addition of cam groove 28 to the arrangement provides considerably more latitude in designing a proper sinker motion.

The present invention has been described in detail above for purposes of illustration only and is not intended to be limited by this description or otherwise to exclude any variation or equivalent form or procedure that would be apparent from, or reasonably suggested by, the foregoing disclosure to the skill of the art.

I claim:

1. In the formation of warp knit fabric made to simulate a woven structure which involves the steps of inlaying spaced warp ends at the back side of a needle array while laying filling ends at opposite sides of the warp inlay, the improvement which comprises operating said needle array and feeding knitting ends thereto to form warp stitch chains at the spaces between said warp ends, while causing all filling ends at the side of said warp inlay adjacent the needles of said array to remain at the back of said needles and forcing all filling ends at the other warp inlay side to the front of said needles in timed relation, so that the filling ends forced to the front of said needles are knit-in by said warp stitch chains and the filling ends remaining at the back of said needles are interlaced by said warp ends and warp stitch chains.

2. In warp knitting apparatus for forming knit fabric having a woven appearance in which means is provided for inlaying spaced warp ends at the back side of a needle array while laying filling ends at opposite sides of the warp inlay and for operating the needles of said array while delivering knitting ends thereto, the improvement which comprises sinker means for holding all filling ends at the side of said warp ends adjacent said needles at the back of said needles while forcing all filling ends at the other warp end side to the front of said needles, and means for operating said sinker means in timed relation so that the filling ends forced to the front of said needles are knit-in by warp stitch chains running at the spaces between said warp ends and the filling ends held at the back of said needles are interlaced by said warp ends and warp stitch chains.

3. In warp knitting apparatus for forming knit fabric having a woven appearance in which means is provided for inlaying spaced warp ends at the back side of a needle array while laying filling ends at opposite sides of the warp inlay and for operating the needles of said array while delivering knitting ends thereto, the improvement which comprises sinker means for holding all filling ends at the side of said warp ends adjacent said needles at the back of said needles while forcing all filling ends at the other warp end side to the front of said needles, said sinker means operating so that the filling ends forced to the front of said needles are knit-in by warp stitch chains running at the spaces between said warp ends and the filling ends held at the back of said needles are interlaced by said warp ends and warp stitch chains.

* * * * *